US007211773B2

(12) United States Patent
Hosoe et al.

(10) Patent No.: US 7,211,773 B2
(45) Date of Patent: May 1, 2007

(54) CONVEYANCE AND FORMING APPARATUS

(75) Inventors: Shigeru Hosoe, Hachioji (JP); Takemi Miyazaki, Hamura (JP)

(73) Assignee: Konica Minolta Opto, Inc. (JP)

( * ) Notice: Subject to any disclaimer, the term of this patent is extended or adjusted under 35 U.S.C. 154(b) by 11 days.

(21) Appl. No.: 11/129,916

(22) Filed: May 16, 2005

(65) Prior Publication Data

US 2005/0258169 A1 Nov. 24, 2005

(30) Foreign Application Priority Data

May 21, 2004 (JP) ..... 2004-151686

(51) Int. Cl.
*H05B 6/10* (2006.01)

(52) U.S. Cl. ..... 219/628; 219/630; 219/631

(58) Field of Classification Search ..... 219/628, 219/629, 630, 631, 687, 772; 137/341; 392/311
See application file for complete search history.

(56) References Cited

U.S. PATENT DOCUMENTS 5,401,938 A * 3/1995 Froeschke et al. ..... 219/602
5,523,550 A * 6/1996 Kimura ..... 219/772
5,773,797 A * 6/1998 Uemura ..... 219/628
5,816,474 A * 10/1998 Flury ..... 228/37
6,310,334 B1 * 10/2001 Niwa et al. ..... 219/644
6,512,212 B1 * 1/2003 Leverne Harris ..... 219/628
6,693,263 B2 * 2/2004 Nishimura ..... 219/615
6,787,742 B2 * 9/2004 Kansa et al. ..... 219/628

FOREIGN PATENT DOCUMENTS

JP 2004-51291 2/2004

* cited by examiner

*Primary Examiner*—Daniel Robinson
(74) *Attorney, Agent, or Firm*—Cantor Colburn LLP

(57) ABSTRACT

A conveyance apparatus comprises a transformer having a core, a primary coil connected to an alternate power source and a secondary coil connected to an output coil, a holding section including a conductive member for heating fluid by high frequency induction heating based on magnetic field generated by the output coil, the holding section for supplying fluid heated by the conductive member and for holding a heating object by the fluid, wherein, the secondary coil is capable of relatively moving to or relatively swinging on the core while the holding section moves.

21 Claims, 11 Drawing Sheets

FIG. 3 ( a )
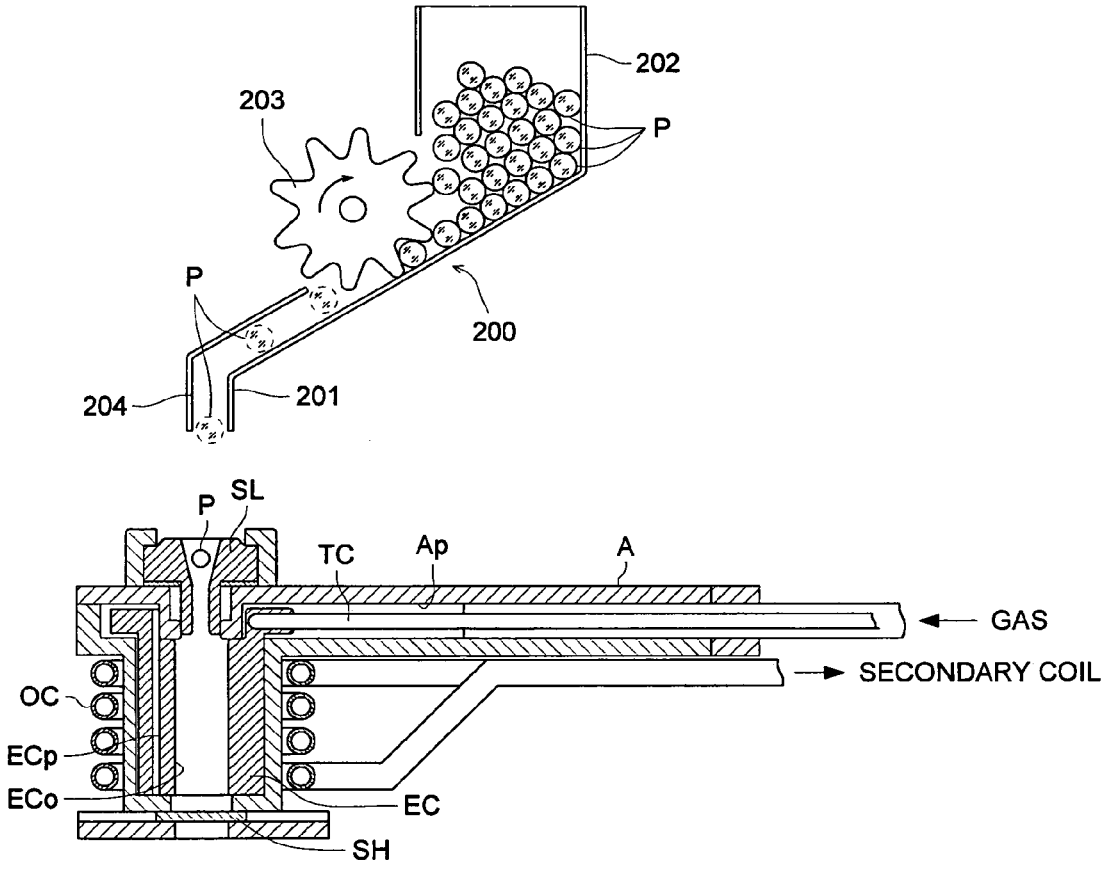
FIG. 3 ( b )
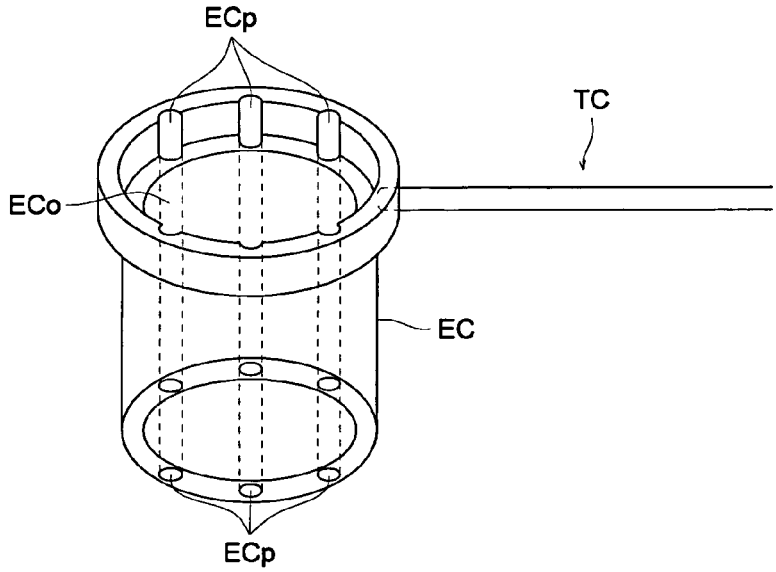

CONVEYANCE AND FORMING APPARATUS

RELATED APPLICATION

This application claims priority from Japanese Patent Application No. JP2004-151686 filed on May 21, 2004, which is incorporated hereinto by reference.

FIELD OF THE INVENTION

The present invention relates to a conveyance apparatus and a forming apparatus suitable for conveying glass for optical elements while heating the glass.

BACKGROUND

Conveyance technology for conveying material for optical elements such as a lens to a forming die by contact-adsorption using an adsorbing pad structured by Teflon (TM) or heat-resistant gum, etc., provided in a conveyance arm is known. The optical element material is heated and softened by a heating device, such as an infrared lamp provided around the forming die. The adsorbing pad is arranged to adsorb a formed optical element for collection after formation.

A forming time can be shortened if the optical element material is heated while it is conveyed. However, it is necessary to covey melting optical element material. Consequently, there is a problem that conveyance is difficult with abovementioned contact adsorption system. Further, in the case of conveying melting optical element material by putting it on a conveyance member equipped with a heater, it is necessary to have a conveyance member having anti-melting device thereon. Further, there is a problem that heating unevenness tends to occur with it. To solve this problem, Japanese Patent Application Open to public No. 2004-51291 discloses technology capable of conveying optical element material with a non-contact state.

According to the technology-disclosed in Japanese Patent Application Open to Public No. 2004-51291, it is possible to hold optical element material in a floating state by blowing high-speed air from the bottom of a supporting apparatus having a funnel shape. However, there is a problem that since the conveyance apparatus includes an electric heater to heat air, electric heater life tends to be rapidly shortened resulting in breaking wire when the temperature of the heater is high, such as 1000° C. Since magnesium oxide powder used for insulation of nichrome wire for the electric heater rapidly starts dielectric breakdown, when temperature reaches more than 900° C., the nichrome wire tends to be short cut. Accordingly, it reduces the operating rate of a conveyance apparatus. Further, it is necessary to pay attention to the safety of a conveyance apparatus and it is difficult to handle with the conveyance apparatus. Even though a case such as the sheath of an electric heater is structured by incoloy 600, etc., which is heat-resisting alloy, it is easily oxidized and blackened, when temperature is more than 700° C. As a result, there is a problem that phenomenon that the surface of the case comes off occurs and foreign matters tend to be generated. In the case of a heating system using gas, once a foreign matter is generated, the foreign matter get into the gas flow and there is a possibility that the foreign matter is easily conveyed to a heating object and adheres on the heating object. Since the foreign matter systematically pollutes the heating object, which is going to be a big problem, every efforts should be made to avoid this implementation. Particularly, a fine structure being a sub-micron order structure is formed on the surface of an optical element for an optical pickup apparatus. Accordingly, if foreign matter adheres on nitric material and the optical transcription surface of an optical element forming die, there is a possibility that the optical characteristics of a formed optical element deteriorates.

SUMMARY

An embodiment of the present invention is to provide a conveyance apparatus and a forming apparatus to solve the problems described above, without having a foreign matter problem, while maintaining reliability.

According to the first embodiment of the invention, an above object of the invention can be attained by a conveyance apparatus comprises a transformer having a core, a primary coil connected to an alternate power source and a secondary coil connected to an output coil, a holding section including a conductive member for heating fluid by high frequency induction heating based on magnetic field generated by the output coil, the holding section for supplying fluid heated by the conductive member and for holding a heating object by the fluid, wherein, the secondary coil is capable of relatively moving to or relatively swinging on the core while the holding section moves.

According to the conveyance apparatus of the present invention, high frequency induction heating heats a conductive member, which heats the heating object via the fluid. Consequently, even though high temperature heating is preformed, no wire-cut problem occurs and the conveyance apparatus can be used for semi-permanent. Particularly, since the secondary coil can be moved according to the movement of the holding section for holding the heating object, the connecting wire connecting the secondary coil to the output coil can be fixed. As a result, it becomes possible to avid repeat bending and scrubbing of wires which occurring when the secondary coil does not move and to improve the reliability of the conveyance apparatus. As a result, when the conveyance apparatus described above is applied for the forming apparatus to convey forming material, total reliability of the forming apparatus through the improvement of the reliability described above and the operating rate can be raised, and which results in cost reduction.

Further, since high temperature heating can be semi-permanently performed with less foreign matter in the high frequency induction heating, there is little possibility of adhesion of foreign matters to the heating object even though heated fluid is blown toward the heating object. Consequently, when the heating objective a nitrate material which is used for formation of highly precise optical elements, the conveyance apparatus of the present invention is suitable for it. Further, "a fluid" described above can be liquid or gas which are easily handled.

According to the conveyance apparatus of the present invention, a heating object can be efficiently heated by applying high frequency induction heating to conductive material. Since, when increasing high frequency input power, temperature can be easily raised until up to the limit of heat-resistance of the part through which the fluid passes, the heating can be surely preformed. In the case of a conventional heater, the life of the heater rapidly comes down and the possibility of wire-cut and a short-circuit goes up when temperature goes up. Accordingly, in order to raise temperature, it is necessary to suppress the temperature rise of the heater itself with a large volume of a heating object which is more than a necessary volume to radiate much heat to avoid heating with no heating object in it. Consequently, power of the heater has to be large, which is inefficient.

Particularly, according to the embodiment, since the temperature adjustment of the conductive member can be rapidly performed by the high frequency induction heating, as a result, a fluid temperature control can be precisely conducted. Accordingly, since thermal inertia becomes small, quick response of temperature adjustment becomes necessary. However, by using conductive member with high frequency induction heating as described in the embodiment, easy temperature control, highly precise temperature adjustment and stability can be attained.

FIG. 1 shows the principle of the conveyance apparatus of the present invention. Primary coil 1C which is connected to an alternate power supply, which is not shown, is wound around an lower-crossbeams of core CR in a rectangular frame and secondary coil 2C is wound around an upper crossbeam of core CR. Secondary coil 2C is held in non-contact state with the upper crossbeam and is connected to output coil OC wound around conductive member E provided on holding section H. Secondary coil 2C together with arm A, which has conductive member H on the front edge of arm A is capable of being slidable. Core CR, primary coil 1C and secondary coil 2C structure transformer T.

Transformer T converts high voltage small current which is supplied by an alternate power supply, which is not shown, to low voltage high current. As a result, transformer T supplies the low voltage high current to output coil OC. Heating object P which is held by holding section H is arranged to be heated by conductive member E which is heated by high frequency induction action.

According to the conveyance apparatus shown in FIG. 1, secondary coil 2C is designed to be driven for sliding relative to core CR according to the movement of holding section H which support heating object P. Accordingly, since core CR and primary coil 1C can be maintained in a fixed state and a portion from secondary coil 2C to holding section H can be maintained in a fixed state as well, wiring through which high frequency power of more than several kW passes can be fixed by passing through cupper pipes to fix the wiring. Namely, according to the conveyance apparatus, since electro-magnetic induction supplies power with a non-contact state to the portion from core CR to holding section H, wiring which connects core CR and holding section H them becomes unnecessary and there in no possibility that wiring is scrubbed, bended, extended and contracted by moving holding section H as in a conventional way. Accordingly, comparing with a case that wiring directly drawn from the power supply to holding section H is implemented, wire-cutting and shorted-circuit due to wiring fatigue can be solved and a semi-permanent life and safety are attained. Additionally, since holding section H does not scrub the wiring, wire connection and wiring relief along with a sliding operation of a moving body become unnecessary, it becomes possible to minimize a setting space and weight of moving parts. As a result, high-speed conveyance driving of heating object P can be attained with high reliability.

FIG. 2 shows a principle of conveyance apparatus of the present invention. Primary coil 1C which is connected to an alternate power supply, (not shown) is wound around a left pole of core CR in a rectangular frame and secondary coil 2C is wound around a cylindrical pole of core CR. Secondary coil 2C is held in non-contact state with the cylindrical right pole-and is connected to output coil OC wound around conductive member E provided with holding section H. Secondary coil 2C together with arm A, which has conductive member E on the front edge of arm A is capable of being swung relative to the right pole and is held so that the secondary coil slides in a longitudinal direction, which is an up-down direction in FIG. 2. Core CR, primary coil 1C and secondary coil 2C structure transformer T.

Transformer T converts high voltage small current which is supplied by the alternate power supply, which is not shown, to low voltage high current. As a result, transformer T supplies the low voltage high current to output coil OC. Heating object P which is held by holding section H is arranged to be heated by conductive member E which is heated by high frequency induction action.

According to the conveyance apparatus shown in FIG. 1, secondary coil 2C is designed to be driven for sliding relative to core CR according to the movement of holding section H which support heating object P. Accordingly, since core CR and primary coil 1C can be maintained in a fixed state and a portion from secondary coil 2C to holding section H can be maintained in a fixed state as well, wiring through which high frequency power of more than several kW passes can be fixed by passing through cupper pipes to fix the wiring. As a result, the same effects as shown with the conveyance apparatus shown in FIG. 1 can be obtained. Additionally, according to the conveyance apparatus shown in FIG. 2, since secondary coil 2C is arranged to be swung around core CR, together with sliding movement of secondary coil 2C, it becomes possible to three-dimensionally move holding section H in any position and conveyance performances of heating object P can be raised.

According to the second embodiment of the present invention, above objects are attained by the conveyance apparatus of the first embodiment described above, wherein the heating object is glass.

In order to maintain an original optical characteristic, such as transparency, even minute dirt is required to be removed from glass. In order to heat glass while maintaining glass quality, a clean conveyance apparatus of the present invention is extremely effective.

According to the third embodiment of the present invention, the above objects are attained by the conveyance apparatuses of the first and second embodiments, wherein the conductive member is structured by conductive ceramic.

Ceramic is in general nonconductor. However, conductive ceramic, such as silicon carbide, silicified molybdenum, etc., is outstanding in conductivity with the level where electric discharge machining can be conducted. Accordingly, since conductive ceramic can generate induction current in its inside, the same as metal, by high frequency, it can be used for high frequency induction heating. Further, since the conductive ceramic is a material which is manufactured via high temperature sintering, the conductive ceramic is originally outstanding in heat resistance. The conductive ceramic is not oxidized nor deteriorated even under a high temperature circumstance. Accordingly, it is suitable for heating parts. When, gas is used as the fluid for heating, it is possible to heat gas by passing through the heated part. Electric discharge machining can easily process to change the form of conductive ceramic to required form of conductive ceramic as a heating medium. Further, since little dirt is generated while heating the heating object, it is clean enough to be used for semi-permanent. Accordingly, conductive ceramic is suitable as heating medium.

According to the fourth embodiment of the present invention, above object can be attained by the conveyance apparatus of the third embodiment, wherein the conductive ceramic is silicon carbide.

Silicon carbide can be heated up to 1500° C. and is particularly high in heat resistance among conductive ceramics. Since degradation does not occur under 1500° C., silicon carbide has advantages that it generates little foreign matters (dirt) and the life is semi-permanent. Further, silicon carbide has a good thermal conductivity of 170 W/mK and a characteristic that an entire part can be efficiently heated while high frequency induction heating is conducted. Further, since silicon carbide has a small coefficient of linear expansion of $3\times10^{-6}$, it is very strong in thermal shock and seldom cracked. Accordingly, it can be rapidly heated and rapidly cooled without damages even free from care. Other conductive ceramics may be used, however, for example, since zirconia has low thermal conductivity of 10 w/mK and large coefficient of linear expansion of $6\times10^{-6}$, it is weak in thermal shock, easily damaged with rapid heating and cooling and care should be paid when handling.

According to the fifth embodiment of the present invention, above objects can be attained by the conveyance of the first embodiment or the second embodiment, wherein the conductive member is structured by precious metal of any one of Pt, Au, Ir, Rh and Pd, or ally which includes any one of Pt, Au, Ir, Rh and Pd.

Since precious metal of any one of Pt, Au, Ir, Rh and Pd, or ally which includes any one of Pt, Au, Ir, Rh and Pd has good thermal conductivity, an entire part can be uniformly heated. Further, since the precious metal has strong combination in high frequency range, it can be heated to higher temperature with less input power. Further, the gas can be heated more than 1000° C. and the part is not oxidized as other metal is oxidized. Further, it has advantages that metal powder does not come out and can be used for semi-permanent.

According to the sixth embodiment of the present invention, the above objects are attained by a conveyance apparatus in any one of embodiment from the first embodiment through the fifth embodiment, wherein the holding section including an arm provided so that the arm moves with the secondary coil, and the output coil is wound around the arm in a longitudinal direction.

When conveying a heating object, it is preferable that the arm is structured so that the arm is extended in a horizontal direction. When structuring necessary member to hold a heating object and supply fluid to the heating object in an extended line from the front edge of the arm, the axis line of the member crosses with the axis line of the arm. Namely, it is common that the axis line of the member perpendicularly crosses to the axis line of the arm, which is disclosed in Japanese Patent Application Open to Public No. 2004-51291. High frequency induction heating inductively heats conductive member around which the output coil is wound. Since, magnetic leakage fluxes from the output coil inductively heat parts located upper and lower portions and left and right portions of the output coil and power is consumed, there is a possibility that the temperature of a heating object does not rise enough and heating of fluid is not conducted enough. On the contrary, if the number of turn of output coil is increased, heating amount of fluid increases. However, in the case that the number of turn is increased along the direction which is vertical to the longitudinal direction of the arm, for example, un-down direction of conductive member, the size of a vertical portion of the holding section becomes large. As a result, it is not convenient to convey the heating object in a narrow area.

In a preferred embodiment, the number of turn is increased by winding the output coil in the longitudinal direction of the arm and thermal dose can be increased while keeping input power low. Further, even though the number of turn is increased without changing the height of the output. Since, in many cases, the length of arm is originally designed to have a long arm for the conveyance supply driving, it is not necessary to newly provide the space for the coil and possible to design a small and light apparatus. This means that mass from the arm to the front portion of the arm can be small. Accordingly, driving force necessary for sliding movement and/or rotation operations can be decreased. As a result, it is possible to obtain less energy consumption, high speed and-high reliability conveyance driving.

According to the seventh embodiment of the present invention, an above objects can be attained by any one of the conveyance apparatus in the first through the sixth embodiments, wherein the secondary circuit of the transformer includes a secondly coil and an output coil.

FIG. 6 shows a principle of conveyance apparatus of the present invention. In FIG. 6, the primary circuit CP1 of transformer T comprises an alternate power supply PWR and condenser CP1 being in parallel connection with the alternate power supply PWR. The secondary circuit of transformer comprises secondary coil 2C and output coil OC which is connected to the secondary coil 2C. Output coil OC is wound around conductive member E.

As described above, since the secondary circuit of the transformer T only includes the secondary coil 2C and output coil OC, it is not necessary to provide other electric parts other than extremely simple fixed wiring, and the weight of the secondary circuit can be light and small. Accordingly, it becomes possible to make the mass of holding section H light. As a result, high speed conveyance with less energy can be possible, high reliability can be secured and low cost apparatus can be attained.

According to the eighth embodiment of the present invention, an above object can be attained by any one of the conveyance apparatus of from the first embodiment to the sixth embodiment, wherein the secondary circuit is a condenser input type.

FIG. 7 shows a principle of a conveyance apparatus of an embodiment of the present invention. In FIG. 7, the primary circuit of transformer T is the same as the configuration shown in FIG. 6. Comparing with a configuration shown in FIG. 6, the difference is that the secondary circuit of transformer T in FIG. 7 includes condenser CP2 between the secondary coil 2C and output coil OC.

Since the secondary circuit does not configure a resonance circuit, there is a possibility that power factor is lowered due to the phase shift between voltage and current. As a result, there is a possibility that the input power of primary circuit does not efficiently transferred to output coil OC. For example, 2 kW power with frequency of 400 Hz is inputted, there is a possibility that the calorific power of output coil is around 500 Watts.

In the configuration shown in FIG. 7, a resonance circuit which resonates with the frequency of primary alternate power supply is configured by adding condenser CP in the secondary circuit of transformer T. It becomes possible to realize highly efficient power transmission, to suppress generation of heat associated with core CR of transformer T and wiring and to decrease power consumption of a power supply. The Q-value of the resonance circuit can be around 20 by optimizing the matching of the capacity of condenser CP2. Even though the weight of the apparatus increases by the weight corresponding to added condenser CP2 as an electric part in the secondary circuit, additional weight will be around 1 Kg even though it depends on the capacity. It is light comparing with total weight of a moving portion of the conveyance apparatus.

With regard to the condenser input type, it is possible to configure a circuit having only resister R and a resonance circuit without transformer T as shown in FIG. 8 in order to improve transmission efficiency to output coil OC. However, there will be side-effect that it takes time to draw the full capability of the circuit. The reasons why are that specifications of conductive member E is changed; when the load is changed, it becomes difficult to resonate the resonance circuit; it becomes necessary to adjust capacities of capacitors CP3 and CP4; and the number of elements to be adjusted increases. Comparing this circuit shown in FIG. 8 with the circuit shown in FIG. 7, it becomes possible to easily improve the efficiency with simple work, even though the power transmission efficiency is not outstanding. This circuit is a practical circuit.

According to the ninth embodiment of the present invention, an above object can be attained by any one of the conveyance apparatus of from the first embodiment to the eighth embodiment, wherein the secondary coil is coaxially wound with the primary coil.

FIG. 10 shows a principle of a conveyance apparatus of an embodiment of the present invention. In FIG. 10, a primary coil 1C connected to an alternate power supply (not shown) is wound around the upper beams of core CR of a rectangular frame. Further, secondary coil 2C is coaxially wound around the first coil 1C. Secondary coil 2C is held in non-contact state with primary coil 1C. Secondary coil is connected to output coil OC which is wound around conductive member E provided with holding section H. Output coil OC is held together with arm A provided on the front end of conductive member E so that output coil OC can slide relative to secondary coil 2C. Transformer T comprises core CR, primary coil 1C and secondary coil 2C.

Transformer T transforms high voltage small current supplied by an alternate power supply (not shown) to low voltage high current which is supplied to output coil OC. The low voltage large current heats conductive member E with high frequency inductive active. Heating object P which is held by holding section H is heated through conductive member E.

In the case of a type of transformer T shown in FIGS. 1 and 2, since magnetic fluxes generated by primary coil 1C generates induction current in secondary coil 2C by passing through core CR. Accordingly heat generation due to magnetic field loss in core CR tends to occur. To solve this problem described above, secondary coil 2C is wound around primary coil 1C to generate current in secondary coil 2*c* wound very close to primary coil 1C. As a result, magnetic field loss caused in material of core CR and generation of heat are suppressed. It becomes possible to efficiently transfer high frequency power with low power input to secondary coil 2C. When a beam cross section of core CR is formed in a circular shape, not rectangular, since primary coil 1C and secondary coil 2C can be wound in a circular shape, arm A can be swung centering on an axis line of secondary coil 2C as shown in FIG. 2.

If secondary coil is wound around the axis line of primary coil 1C, secondary coil 2C is not necessary to be coaxially wound around primary coil 1C. For example, magnetic field loss of core CR can be suppressed by shortening a distance from primary coil 1C to secondary coil 2C. This can be realized by winding primary coil around a part of a long beam and secondary coil the other part of the long beam. In this case, it becomes possible to keep the winding diameter of secondary coil short. Accordingly, it becomes possible to suppress the magnetic field loss of core CR. In this case, a winding diameter can be kept small.

According to the tenth embodiment of the present invention, an object of the present invention can be attained by one of the conveyance apparatus of from the first embodiment to the ninth embodiment, wherein the holding section floats and holds heating object by fluid heated by the conductive member. According this embodiment, since the heating object does not contact nor adhere with parts around the heating object, the heating object can be kept clean. As a result, high quality can be maintain.

According to the eleventh embodiment of the present invention, an above object can be attained by the conveyance apparatus of embodiment 10, wherein the holding section contains a hole provided through the holding section in a gravity direction, wherein the internal surface forming the hole is formed in a taper shaped, an upper portion of an internal surface of the hole being extending toward an open end edge of the hole, and fluid heated by the conductive member is supplied through a bottom portion of the hole.

Since the fluid heated by the conductive member is supplied through the hole to the heating object, the heated fluid stream becomes stable and it can holds the heating object against the gravity by the force of the fluid. Accordingly, since it becomes possible to float heating object in a non-contact state, heating can be conducted while avoiding adhesion and dirt of the heating object and keeping the heating object in a high quality. Further, when conveying the heating object, the fluid blown through the taper shape surrounds the heating object. Accordingly, the heating object can be stably held and secure conveyance can be carried out.

According to the twelfth embodiment, an above object can be attained by the conveyance apparatus of the eleventh embodiment, wherein at least the member for forming the hole provided on the holding section includes precious metal of any one of Pt, Au, Ir, Rh and Pd, or alloy including at least one of is any one of Pt, Au, Ir, Rh and Pd.

Precious metal of any one of Pt, Au, Ir, Rh and Pd which forms at least a member in which the hole is formed, or alloy which includes any one of Pt, Au, Ir, Rh and Pd has a characteristic that the heating object being heated to high temperature is hard to get wet, when touching with the precious metal or the alloy. If the heating object having high temperature contacts the tapered portion of the hole, the heating object can be controlled not to adhere to the surface of the hole of supporting member. As a result, a secure conveyance is attained. In the case that the heating object is glass, if the member having the hole is structured by platinum or alloy of platinum and gold, since it has a characteristic that it is hart to get wet, it does not adhere and it becomes possible to heat glass more than 1000° C. without adhesion. In the case that the heating object is glass, the wettability is the lowest when an alloy particularly contains gold with 5–7%, even in the alloy of platinum and gold. As a member in which a hole is formed, the alloy is particularly hard to be adhered and capable of being heated to high temperature.

According to the thirteenth embodiment, an above object can be attained by the conveyance apparatus of the eleventh embodiment or twelfth embodiment, wherein the internal surface forming the hole is cooled by coolant of an cooling apparatus so that the temperature of the internal surface forming the hole is lower than that of the heating object.

For example, when the heating object is glass, since a glass has a characteristic that the glass is hard to get wet against the substance having lower temperature than that of the glass. Accordingly, the heated and softened glass is hard to get wet with the internal circumference surface of the hole, if the internal circumference surface of the hole (including the aforementioned taper section), which has possibility to be contacted due to the vibration occurred while the glass is heated and floated is cooled.

According to the fourteenth embodiment, an above object is attained by the conveyance apparatus of the thirteenth embodiment, wherein the coolant is liquid or gas.

For example, since a cooling system using gas can be easily realized and the degree of cooling can be easily adjusted, adhesion can be easily prevented and the heating object can be floated and held with an optimum condition without lowering the temperature of heating object. Further, the kind of gas is not specified, however, air or nitrogen gas is preferable from the point of cost and handling point of view.

On the other hand, a cooling system using liquid can efficiently lower the temperature of internal surface forming the hole than a cooling system by gas. Since, as the kind of liquid used for cooling, it is preferable to have a large specific gravity and high cooling efficiency and no possibility of inflammation when leaking of the liquid happened. From these points, water is preferable.

According to the fifteenth embodiment of the invention, an object described above is attained by any one of the conveyance apparatus of from eleventh to fourteenth embodiments, wherein the hole has a internal diameter through which a heating object can pass and an open/close shutter is provided under the hole.

According to this embodiment, the heating object can be taken out from the lower portion of the hoe by a simple open/close operation of the shutter. Further, since it is simple to adjust the position of the hole to the position where the heating object is placed, positioning is easy and placing operation or inputting operation can be securely conducted.

According to the sixteenth embodiment of the invention, above objective can be attained by any one of the conveyance apparatus of from the first to the fifteenth embodiment, wherein the holding section can be moved from the ejecting position of the heating object within two seconds after ejecting the heating object.

In the case of that glass material is used for the heating for formation and the present embodiment is used for heating the heating object while conveying it to a forming die of a forming apparatus, since this embodiment can prevent the glass from being cooled by the forming die before press forming, the improvement of forming reproducibility and forming transcription can be expected. Since it is possible to make the conveyance structure capable of holding the heating material small by applying the invention, high speed moving-out operation can be attained with a little energy. Since it is possible to shorten a time from the time when putting glass into the forming die to press forming, the press forming can be started before the glass hardly gets cold and high livability forming can be attained. As a result, highly precise glass optical element can be speedily formed with a high yield.

According to the seventeenth embodiment of the invention, an above object can be attained by any one of the conveyance apparatus of from the first to the sixteenth embodiment, wherein the conveyance apparatus is applied to a forming die of the forming apparatus for forming optical elements.

According to the conveyance apparatus, highly precise glass optical elements can be speedily and steadily formed with high yield. As a result, the performance these optical element is high and little variation. Consequently, it is possible to manufacture these optical elements with low cost if the performance is normal.

According to the eighteenth embodiment of the invention, an above object can be attained by any one of the conveyance apparatus of the seventeenth embodiment, wherein the holding section conveys the heating object to the forming die while heating.

According to the nineteenth embodiment of the present invention, an above object can be attained by a forming apparatus having any one of the conveyance apparatus of from the first to the eighteenth embodiments, wherein the heating object is conveyed by the conveyance apparatus while heating to form an optical element.

The optical elements used in this specification, for example, are a lens, a prism, a diffraction optical elements, (such as a diffraction lens, a diffraction prism and a diffraction plate), a optical filter (such as a space low pass filter, a wavelength band pass filter, wavelength high pass filter, etc.,), a polarized filter (such as an analyzer, a polarizer, a polarized separating prism, etc.,) and a phase filter (a phase hologram). However it is not limited to these optical elements.

According to an embodiment of the present invention, it is possible to provide a conveyance apparatus to avoid problems associated with dirt or foreign matter while keeping reliability.

BRIEF DESCRIPTION OF THE DRAWING

Embodiments will now be described, by way of example only, with reference to the accompanying drawings which are meant to be exemplary, not limiting, and wherein like elements are numbered alike in several FIGS. in which:

FIG. 3(*a*) illustrates a cross sectional view of the first embodiment of the invention and FIG. 3(*b*) illustrates a perspective view of the conductive cylinder member EC used for an embodiment of the present invention.

DETAILED DESCRIPTION OF PREFERRED EMBODIMENT

Embodiments of the present invention will be described below. FIG. 3(*a*) illustrates a cross sectional view of the conveyance apparatus together with pre-form P of glass and pre-form supplier 200, and a structure corresponding to a front end portion of arm A shown in FIG. 1 or FIG. 2. FIG. 3(*b*) illustrates a perspective view of the conductive cylinder member EC used for the embodiment of the present invention (which is corresponding to the conductive member of the present invention). With regard to the supporting system and the driving system of arm A will be described by using FIGS. 12 and 13 together with other embodiments.

In FIG. 3(*a*), path Ap is formed in arm A extending to a horizontal direction, and thermocoupler TC for measuring temperature is laid down in path Ap. The front end of arm Ap is formed in a cylindrical shape, and conductive cylinder member EC structured by conductive ceramic is provided in the front end of arm Ap. Conductive cylinder member EC is structured by bulk material (it may be porous material) and hollow. The internal surface of conductive cylinder member EC forms a hole. A detector of thermocoupler is attached on conductive cylinder member EC.

As shown in FIG. 3(*b*), six path Ecps extending in a up and down direction with a equal interval is provided in conductive cylinder member EC for guiding gas across central hole Co.

When conductive cylinder member EC is structured by bulk material, path ECp is a through hole. After gas is heated while passing through path ECp, the gas flows into central hole Eco from the crevice between the cylindrical portion of arm A around path ECp and conductive-cylinder member EC and floats pre-form P. On the contrary, when conductive cylinder member EC is structured by porous material, if path ECp is not a through hole but a half way hole, the gas surely comes out through the wall of conductive cylinder member EC. Accordingly, since gas does not leak downward, it excels in heating efficiency.

Figure 4:
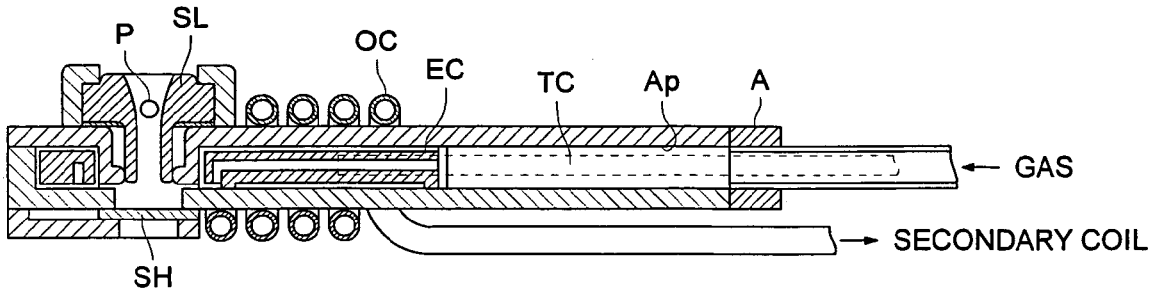
FIG. 4(*a*) illustrates a cross sectional view of the embodiment shown in FIG. 2 which is the same as FIG. 3(*a*) and FIG. 4(*b*) illustrates a perspective view of the conductive cylinder member EC.
Figure 4:
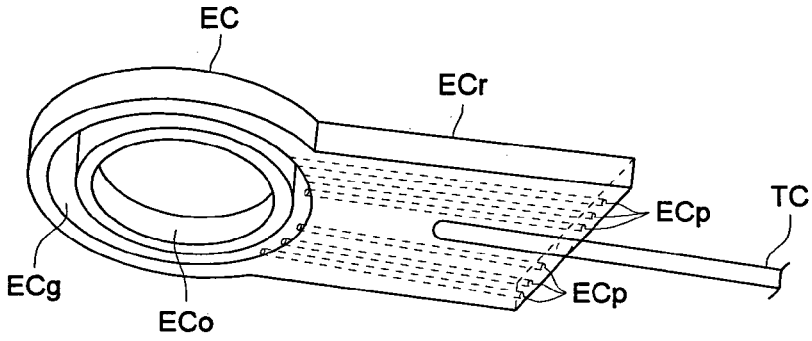

When the conductive cylindrical material EC as shown in FIG. 4(*b*), which will be described later, is formed with porous material, gas passes through the inside of porous material from peripheral groove ECg, and oozes out to the central hole ECo. On the other hand, since gas flows in the central hole ECo through the crevice between the cylindrical portion of the arm A around peripheral groove ECg and peripheral groove Ecg, when the conductive cylinder member EC of the form shown in FIG. 4(*b*) is formed by bulk material, a part of gas in contact with the cylindrical portion of the arm A exposed to room temperature will be cooled, and, only in that part, heating efficiency worsens. Then, many minute holes are opened in the wall inside the conductive cylinder member EC (since it is a conductive material and electrical discharge machining is made, a hole with a diameter of about. 0.2 mm can also be opened easily), and it may be allowed that gas ooze out from peripheral groove Ecg as if gas flows into the central hole ECo. Although it will be bulk material when forming the conductive cylindrical material EC with precious metals material, the advantage that electric power is sharply reduced, which will be described later.

Namely, conductive cylinder member EC of this embodiment may be formed by either porous material or bulk material. In the case of porous material, medium, such as gas, directly pass through the inside of the heated conductive cylinder member EC. Since gas flows into the central hole ECo through the conductive cylinder member EC for floating pre-form P, heating efficiency is very good. And, since pressure loss occurs is in passage, mild heated gas having little unevenness flows into central hole ECo. As a result, float of pre-form P becomes stable. On the other hand, when the conductive cylinder member EC is manufactured with bulk material, since it can be made to flow gas into the central hole ECo by making the small hole and crevice through which gas passes while heating, it becomes easy to manufacture parts having few variations without being dependent on the result of material, and having stable heating performances and flux performance based on machining.

As shown in FIG. 3(*a*), hollow sleeve SL having a tapered portion in an internal surface is attached on an upper portion of conductive cylinder member EC. Sleeve SL is formed by precious metal of one of Pt, Au, Ir, Rh and Pd, or alloy including any one of them. Sleeve SL is connected with a central hole of conductive cylinder member EC to form a through hole in an up-and-down direction. Shutter SH capable of being freely opened and closed is provided in a lower portion of sleeve SL. Shutter SH is arranged to close central hole EC of conductive cylinder member EC when shutter SH is closed and to open the lower end edge when-opened.

Output coil OC is wound around conductive cylinder member EC. A winding axis of the output coil OC is aligned to a vertical direction (an up-down direction). Output coil OC is connected to secondary coil 2C (refer to FIGS. 12 and 13). Transformer T (refer to FIGS. 12 and 13), output coil OC, conductive cylinder member (conductive member) EC form a heating device and central hole ECo forms a feeder. And in this embodiment of the invention, conductive cylinder member EC, central hole Eco, sleeve SL and arm A form holding section. It is possible to divide holding section into two parts. For example, conductive cylinder member EC and sleeve SL may be divided into two separated sections which can be separately deployed and moved independently.

As shown in FIG. 3(*a*), pre-form feeder 200 comprises stocker 202 for holding pre-form P which is many glass ball, sprocket 203 for supplying pre-form P one by one to feeding gate of pre-form feeder 201 by a rotating operation and feeding gate 204.

Next, in a forming apparatus having a conveyance apparatus of the embodiment of the invention and a forming die, an operation for conveying pre-form P to the forming die in the conveyance apparatus will be described. As shown in FIG. 3(*a*), arm A is moved to a position where feeding gate 204 and sleeve SL are positioned to substantially match the both axes of feeding gate 204 and sleeve SL under pre-form feeder 200. Then, pre-form P (it may be called a heating object) in stocker 202 is sent out and dropped from feeding gate 204 by rotating sprocket 203 by one rotation of tooth of a toothed gear.

At this time, shutter SH is closed and dry nitrogen gas (nitrogen density is not less than 60 mol %) is sent with pressure from outside into path Ap. Accordingly, the dry nitrogen gas passes through path ECp of conductive cylinder member EC and substantially uniformly blows toward upward from a lower section of central hole Eco. Consequently, the dry nitrogen gas receives dropped pre-form P in sleeve SL and can float it in a non-contact state. In this case, since internal surface of sleeve SL is formed in tapered shape, when the pressure of the dray nitrogen gas rapidly change, pre-form P is steadily held at the boarder between a strait section and a tapered section.

At this moment, if power is supplied to output coil OC, conductive cylinder member EC is heated by high frequency induction heating. Consequently, the dry nitrogen gas passing-through path ECp is heated and the outside surface of pre-form P is appropriately heated. Further, since pre-form P is rotated, swung and vibrated by the dry nitrogen gas, the whole periphery surface of pre-form P is uniformly heated.

Figure 11:
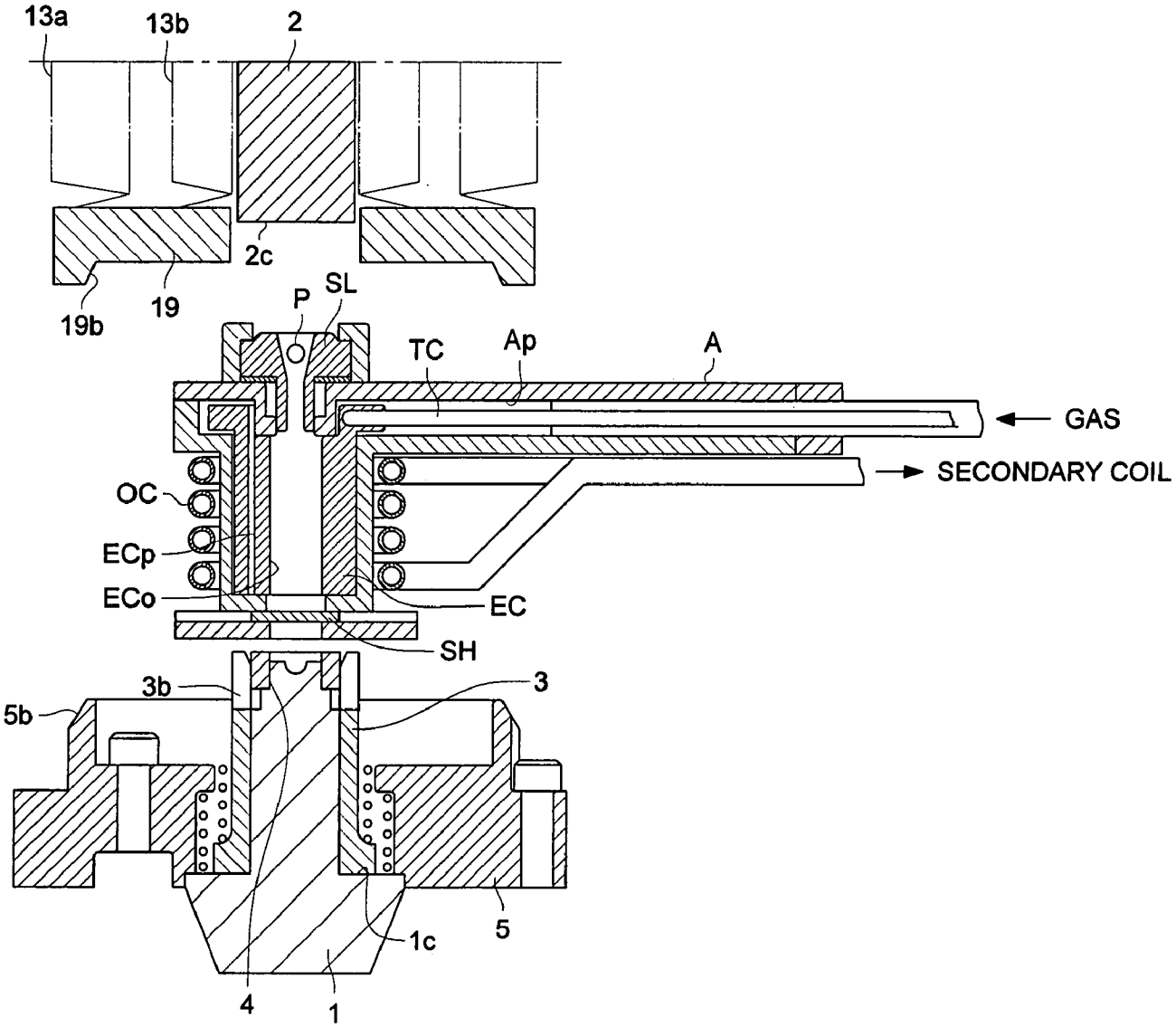
FIG. 11 illustrates an enlarged view of periphery of a forming die in a conveyance apparatus together with a part of conveyance apparatus.

Arm A is moved while pre-form P is floating so that sleeve SL positions between lower die 1 and upper die 2 (they are called a forming die as a general term) of an forming apparatus, a whole of which is not shown, as shown in FIG. 11. After that, shutter SH is moved to an open-position by an actuator (not shown). Then the pressure of the dry nitrogen gas which holds pre-form P goes down. The pre-form P cannot be held any more and stats to drop through a strait section of sleeve SL and ejected from a lower portion of central hole Co. Since sleeve SL and conductive cylinder member EC are formed by material having a low wettability against softened glass, pre-form P is securely dropped into the cavity of lower die 1 without adhesion of pre-form P.

After ejection of pre-form at an ejection position, arm A is moved out from the ejection point. Then a forming operation starts and lower die 1 is elevated to an adjacent position where upper die 2 is located. Further, nitrogen gas (it may be air) is sent to a space of metal bellows 13A and 13B, which are metal members with pressure to expand metal bellows 13A and 13B. Expanded metal bellows 13A and 13B push taper surface 19*b* of pushing member 19 which moves together with a lower edge to tapered surface 5*b* of fixing member 5 opposing to tapered surface 19*b* to make close contact with each other. Based on this operation, a periphery space of forming position where pre-form P is positioned is shielded from outside atmosphere. In this state, nitrogen gas residing inside the space is exhausted by a pump being a vacuum drawing device to reduce pressure of the periphery space of forming die to the pressure of not more than 1 kPa in vacuum degree. A scroll type vacuum pump is compact and an exhausting efficiency is good. Further, since the scroll type vacuum pump does not use oil, maintenance-serviceability is good and it make barely noise. It is preferable from the viewpoint of environments. And it takes about 1 second to reduce pressure.

Further, since pre-form P being a material to be formed has been softened to the temperature at which press can start in advance, at the same time when the forming die is closed and vacuum drawing starts, lower die 1 starts-elevation and a pressing operation can starts. Cylindrical barrel die 3 is fitted with the periphery of lower die 1. When lower die 1 elevates, the top end surface of barrel 3 closely contacts with reference surface 2*c* of upper die 2, and parallelism between reference surface of 2*c* of forming die 2 and reference surface 1*c* of forming die 1 is maintained. After keeping the same state for several seconds, nitrogen gas is inputted to the space of periphery of forming dies 2 and 1 which has been in a state of reduced pressure, and heating temperature of the inside of the die is controlled so that the temperature goes down to the temperature not more than transition temperature.

After that, the nitrogen gas in metal bellows 13A and 13B having double structure is exhausted and fixing member 5 is separated by shrinking metal bellows 13A and 13B. Preform P is formed based on the processes described above.

FIG. 4(*a*) illustrates a cross sectional view, which is the same as FIG. 3(*a*) which illustrates the cross sectional view of the second embodiment of the invention. FIG. 4(*b*) illustrates a perspective view of the conductive cylinder member EC. Main different point between this embodiment and the first embodiment is the winding axis direction of output coil OC. Namely, output coil OC is wound along the longitudinal direction of arm A. Accordingly, as shown in FIG. 4(*b*), conductive cylinder member EC is shaped thin in a vertical direction, and a part of conductive cylinder member EC becomes rectangular plate ECr extending to the longitudinal direction of arm A. Periphery groove Ecg having a bottom surface, which is located in upper portion, is formed around central hole ECo in conductive cylinder member EC and path ECp is formed in rectangular plate ECr so as to communicate from outside to periphery groove ECg. Since the other structures and operations are the same as the embodiment, the same code is used for the same element and description for those elements will be eliminated.

According to the embodiment of the invention, since output coil OC is wound in a longitudinal direction, many number of winding can be possible and increase thermal dose while limiting input power. Further, even though number of winding of output coil increases, the height in an up-down direction of output coil OC does not change. Since, in many cases, the length of arm is originally designed to have a long arm for the conveyance supply driving, it is not necessary to newly provide the space for the coil and possible to design a small and light apparatus. This means that mass from the arm to the front portion of the arm can be small. Accordingly, driving force necessary for sliding movement and/or rotation operations can be decreased. As a result, it is possible to obtain less energy consumption, high speed and high reliability conveyance driving.

Figure 5:
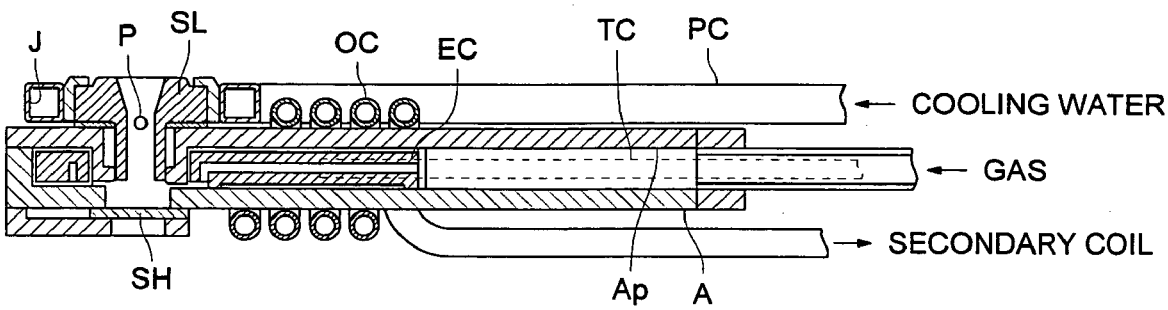
FIG. 5 illustrates a cross sectional view of the embodiment shown in FIG. 3(*a*) which is the same as FIG. 4(*a*).
Figure 5:
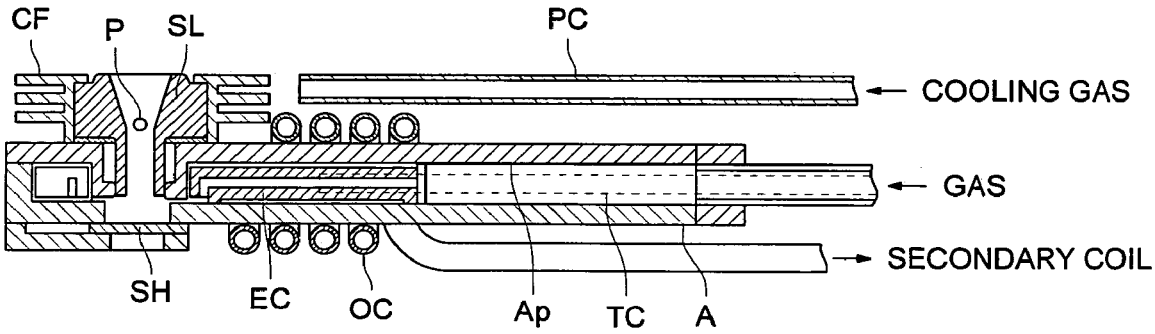

FIG. 5 illustrates a cross sectional view being the same as FIG. 4(*a*) which illustrates the third embodiment of the invention. The main different point from the second embodiment of the invention is that a cooling mechanism for cooling sleeve SL is provided. In concrete, in an example shown in FIG. 5, jacket J as a water cooling system is formed so as to surround the outer periphery of sleeve SL (in the example, a part of arm A is interposed, however direct contact is allowed). Cooling water is supplied through pipe PC to jacket J. Even when heated and softened pre-form P happen to touch with internal surface, it becomes possible for the pre-form P not to easily adhere to the internal surface. Since the other structures and operations are the same as the embodiment, the same code is used for the same element and description for those elements will be eliminated.

Further, in an embodiment of the invention shown in FIG. 5(*a*), air cooling fin CF as a air cooling system is formed on a part of arm A which surrounds the outer periphery of sleeve SL. Cooling gas is supplied though pipe PC to cooling fin CF. A cooling system using cooling gas is structured by using a simple mechanism and the degree of cooling is easily adjusted by changing flow rate. Accordingly, adhesion is easily prevented and there is few possibility to affect for temperature adjustment for pre-form P. As a result, holding of pre-form P is conducted in an optimum condition. Since the other structures and operations are the same as the embodiment, the same code is used for the same element and description for those elements will be eliminated.

Figure 10:
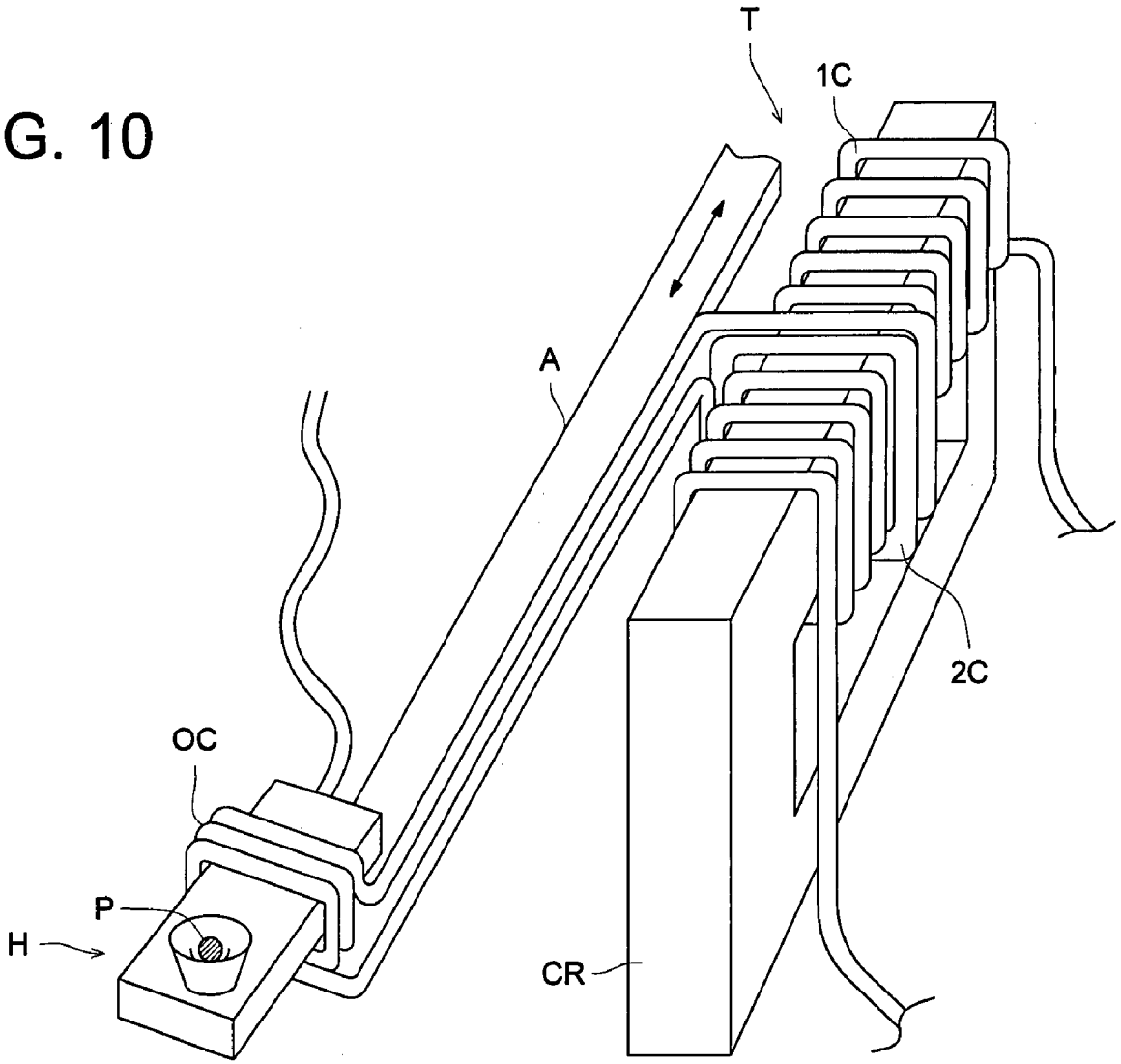
FIG. 10 illustrates the principle of the conveyance apparatus of the present invention.
Figure 12:
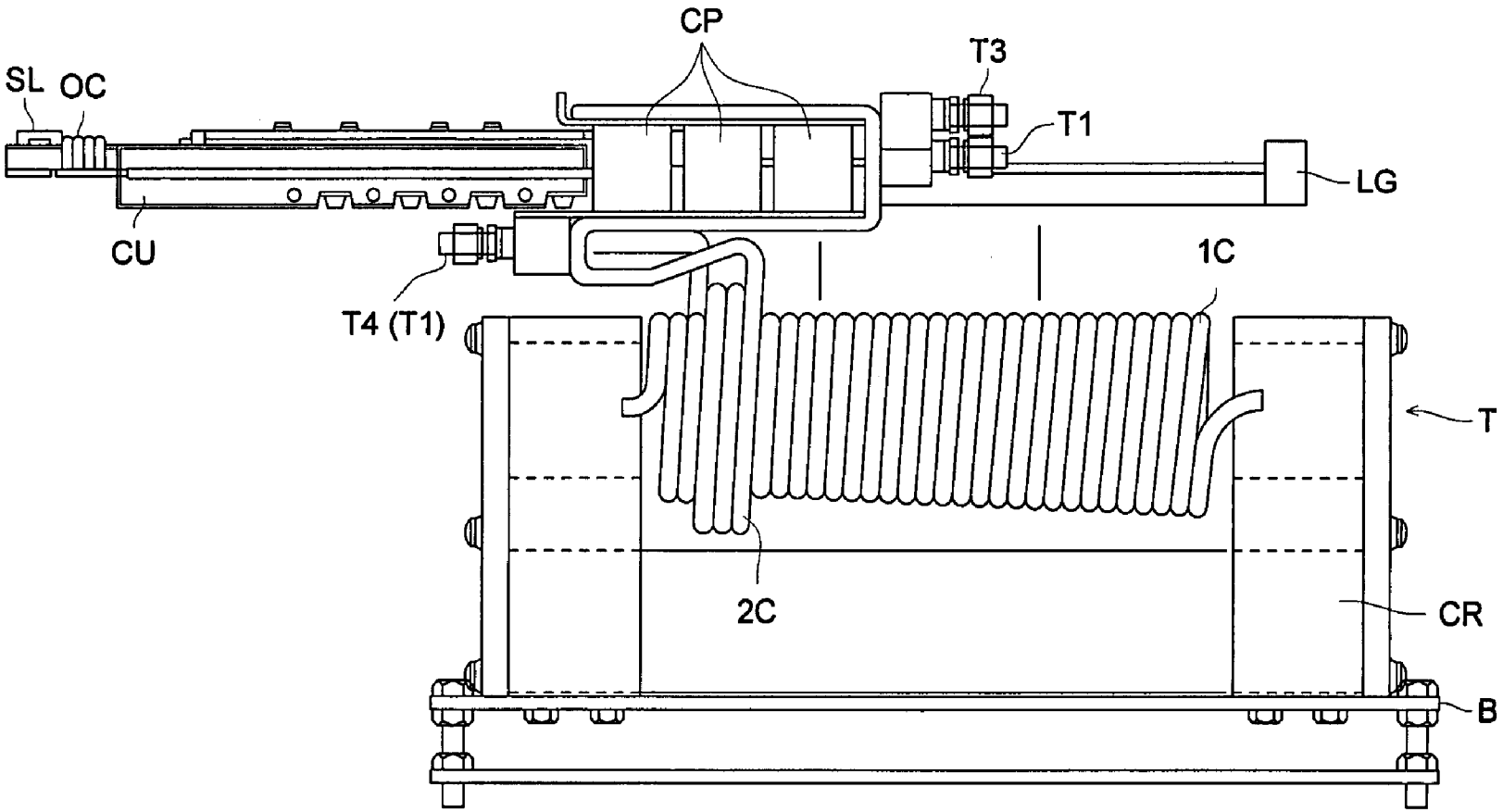
FIG. 12 illustrates a side view of a conveyance apparatus provided with an arm shown in FIG. 5(*a*) and a transformer of the type shown in FIG. 10.
Figure 13:
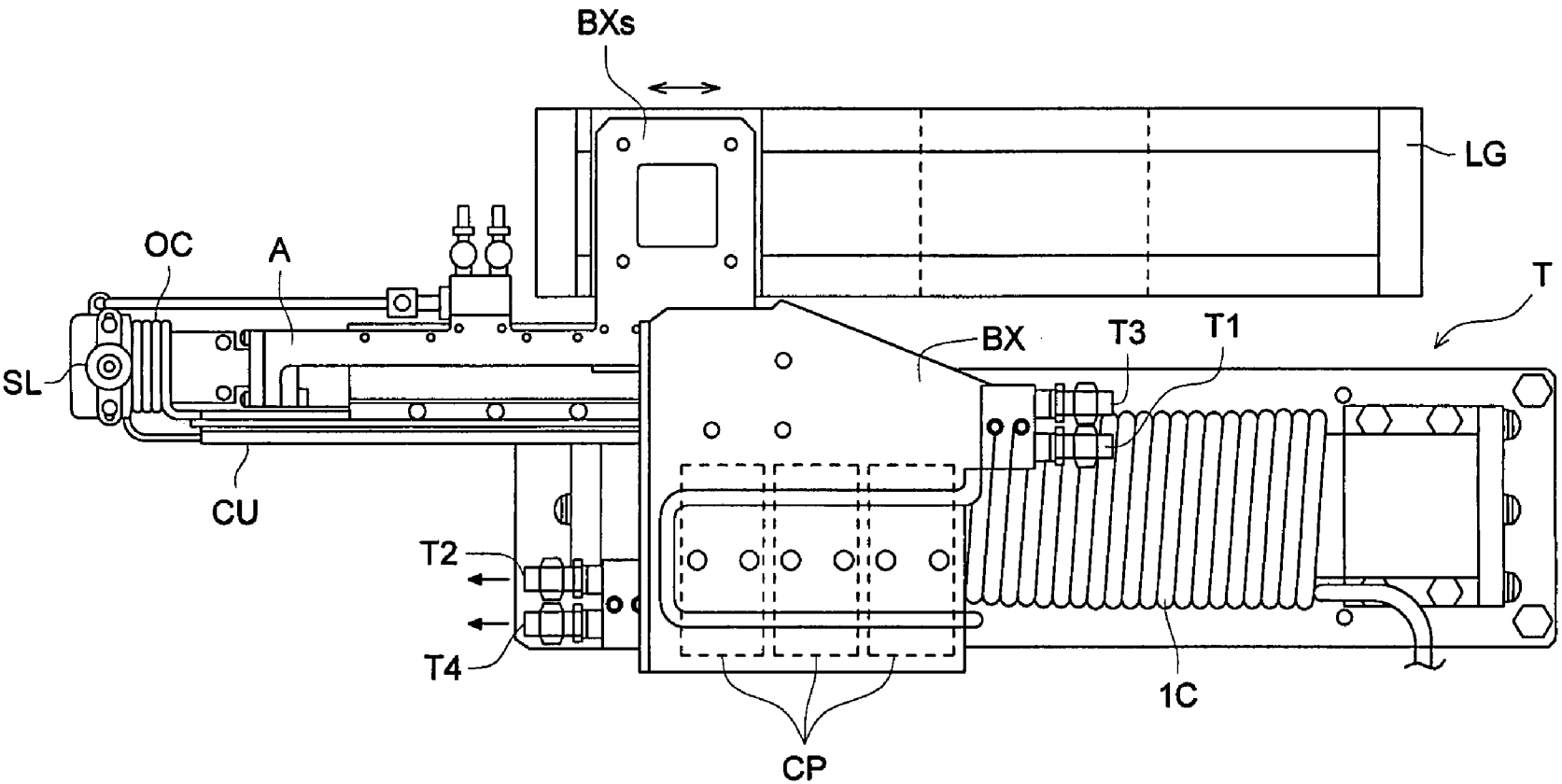
FIG. 13 illustrates a top view of a conveyance apparatus provided with an arm shown in FIG. 5(*a*) and a transformer of the type shown in FIG. 10.

FIG. 12 illustrates a side view of a conveyance apparatus of the invention having an arm shown in FIG. 4(*a*) and transformer T shown in FIG. 10. FIG. 13 illustrates a top view of the conveyance apparatus shown in FIG. 12. In FIG. 12, core CR is placed on a base B provided on a surface table (not shown) and linear guide LC is provide on base B.

Primary coil 1C connected to an alternate power supply (not shown) is wound around the upper beams of core CR of a rectangular frame. Further, secondary coil 2C is coaxially wound around the first coil 1C. Secondary coil 2C is held in non-contact sated with primary coil 1C. Secondary coil is connected to output coil OC via a pair of cupper plates 2C which are insulated each other.

Thin body BX is provided on transformer T. Body BX having supporter BXs capable of moving along linear guide LG and arm A is attached to supporter BXs in a single holding method. Since, an air cylinder (not shown) is provided in linear guide, body BX is arranged to move along linear guide LG together with arm A in a left and right direction in FIGS. 12 and 13, base on a drive of the air cylinder. Further, condenser CP forming a circuit for transformer T is provided in body BX. Connector T1 attached to body BX is an entrance of cooling water for cooling sleeve SL and connector T2 is an outlet of cooling water for cooling sleeve SL. Connector T3 is an entrance of cooling water for cooling secondary coil 2C and condenser CP and connector T4 is an outlet for cooling secondary coil 2C and condenser CP.

It becomes possible to improve power transmission efficiency and to reduce input power comparing with a circuit having only coil by providing a condenser input type circuit for improving power transmission efficiency. However the weight of body BX increases by the weight of the condenser. However, since the total weight of condenser used for the conveyance apparatus shown in FIGS. 12 and 13 is, about 300 g/unit, total weight of three condensers is 900 g. The air cylinder provided in linear guide LG can move boy BX for total stroke 150 mm in 0.5 seconds.

In this embodiment, in order to obtain 500 W at output coil OC, about 650 W is necessary as an input power, which is quite good power transmission efficiency with low power loss. As a result, there are advantages that leaked magnetic flux is little and induced heating associates with metal parts used in the conveyance apparatus is almost prevented. For example, when arm A is formed by SUS304, it is possible to control temperature raise not more than 10° C.

Figure 1:
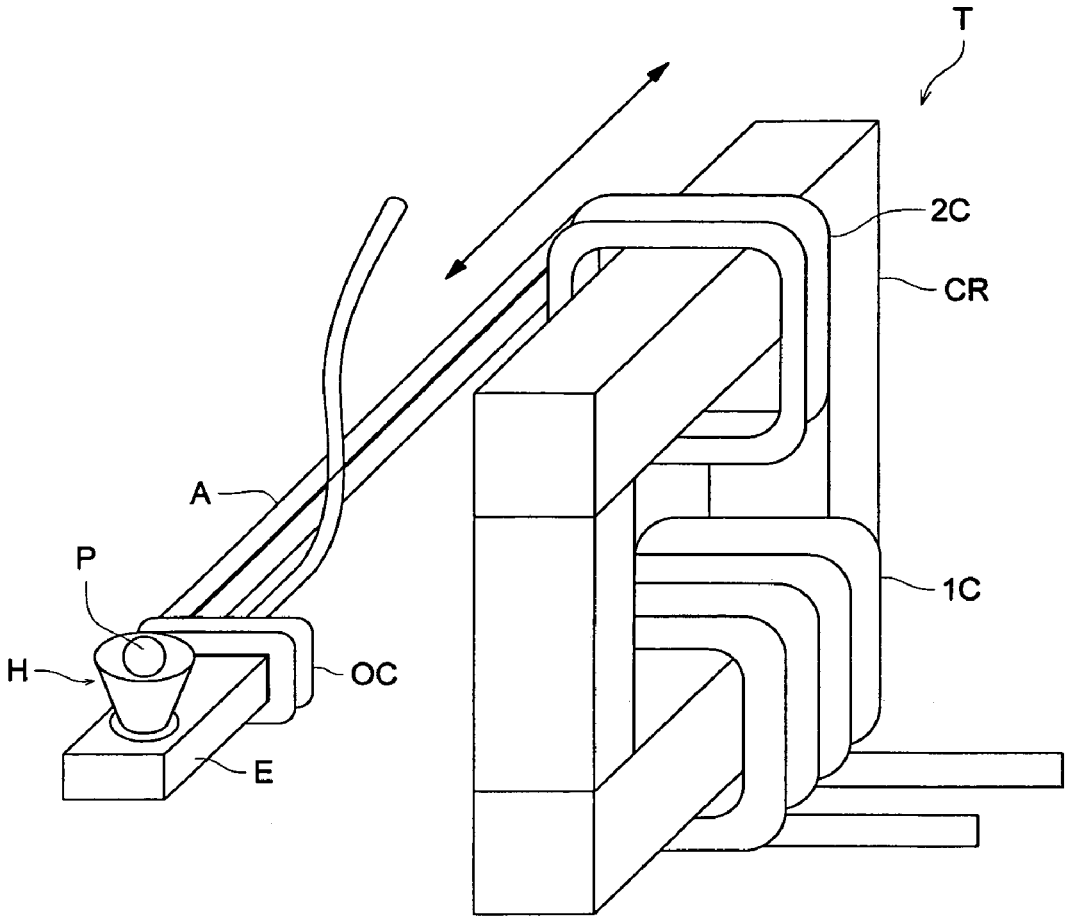
FIG. 1 illustrates the principle of the conveyance apparatus of the present invention.
Figure 2:
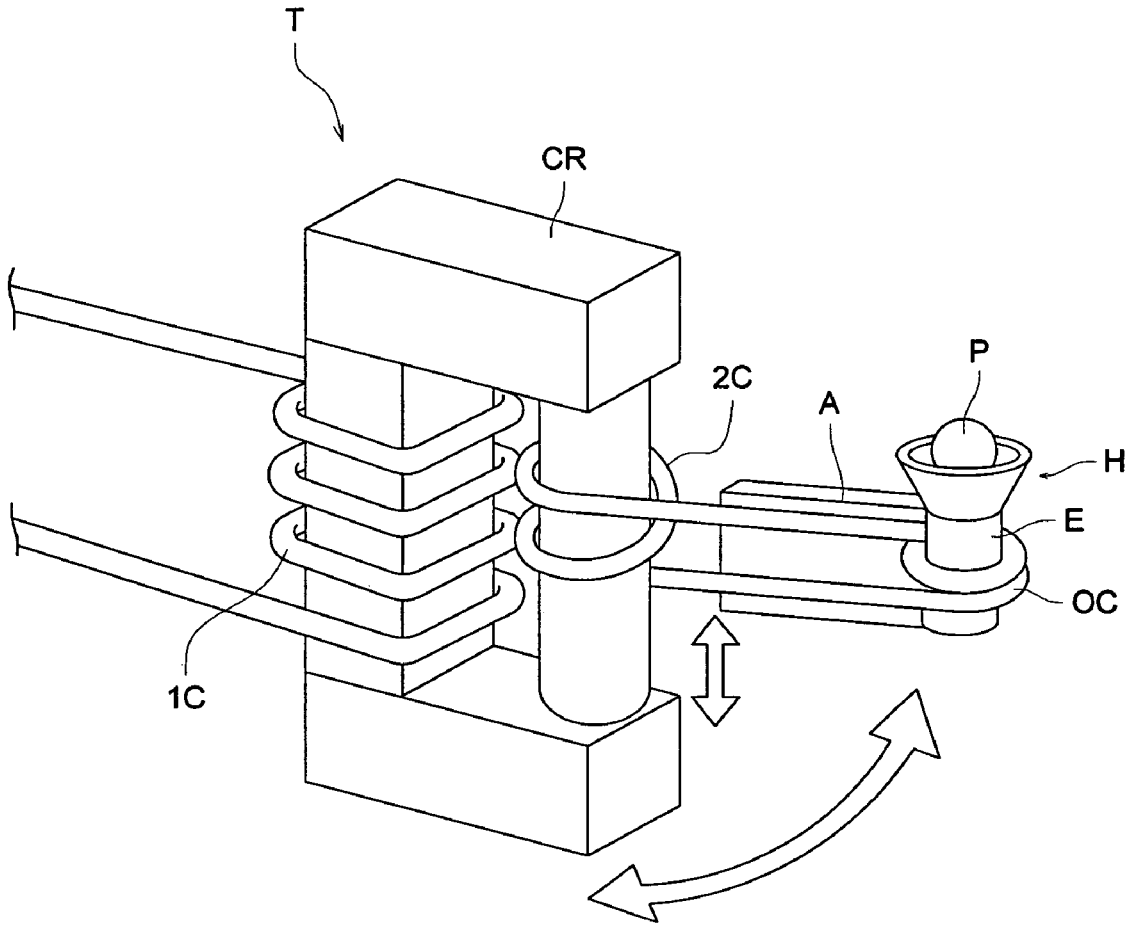
FIG. 2 illustrates the principle of the conveyance apparatus of the present invention.
Figure 6:
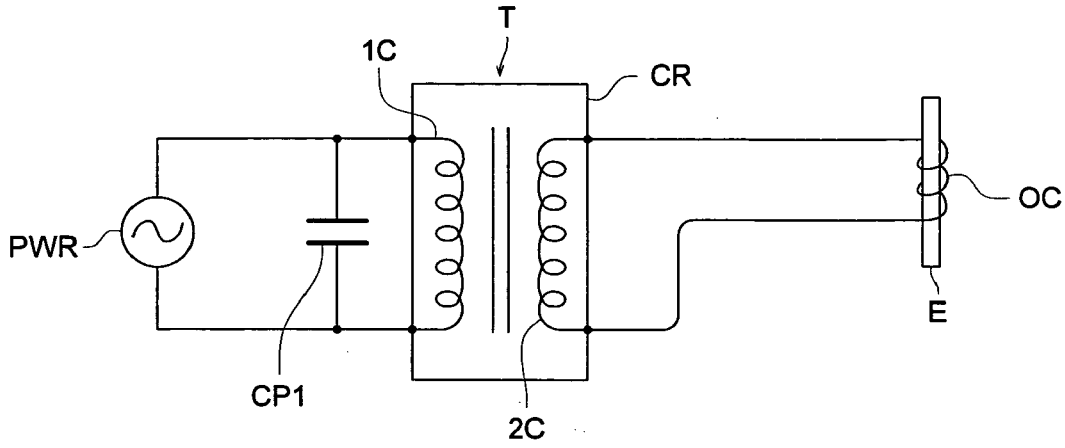
FIG. 6 illustrates a circuit performing high frequency induction heating of the present invention.
Figure 7:
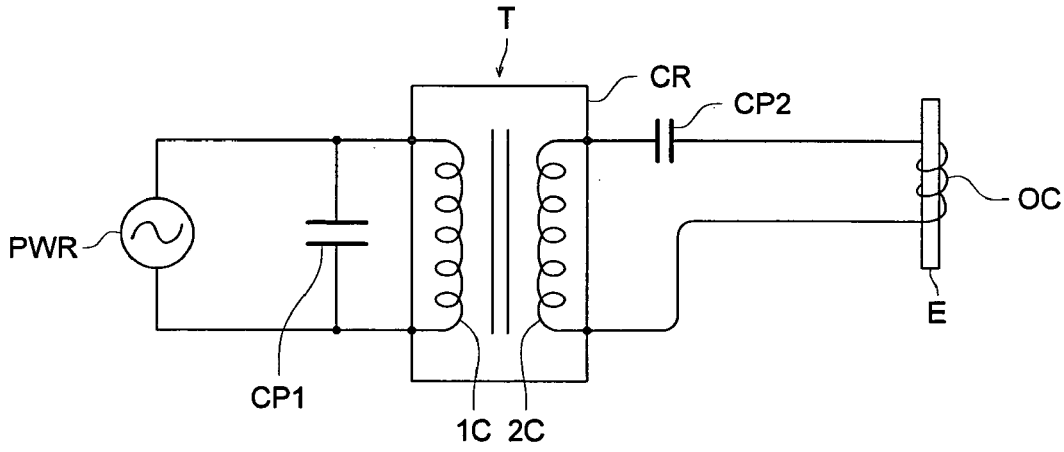
FIG. 7 illustrates a circuit performing high frequency induction heating of the present invention.
Figure 8:
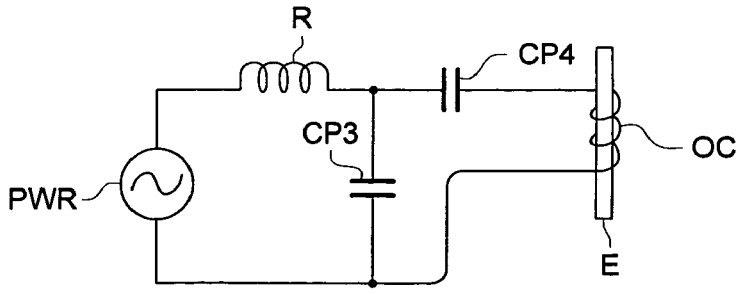
FIG. 8 illustrates another circuit performing high frequency induction heating of the present invention.
Figure 9:
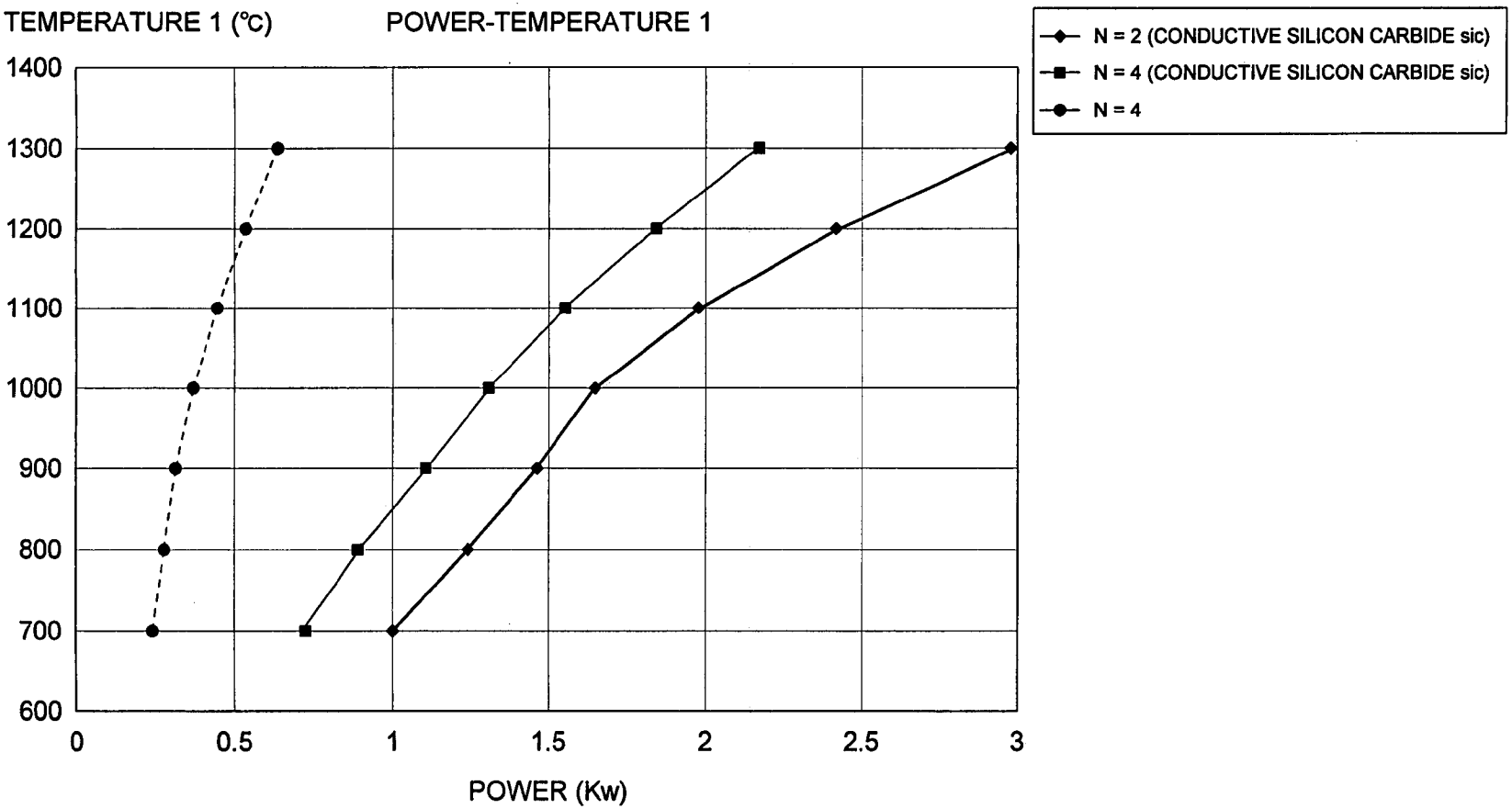
FIG. 9 illustrates a graph showing the measurement result of the temperature of a heated element passing through gas and alternative power source when the conveyance shown in FIG. 3(*b*) is fixed on a bench.

FIG. 9 illustrates a graph showing the measurement result of the temperature of a heated element passing through gas and alternative power source when the conveyance shown in FIG. 3(*b*) is fixed on a bench. The circuit shown in FIGS. 1 and 6 are used as the secondary circuit of the transformer.

When the winding number of an output coil is two, even though output coil space can be small, heating efficiency is very low. In the case that conductive cylinder member to be heated is structured by silicon carbide, in order to raise temperature to 1000° C., about power of 1.7 kW, and to 1300° C., power of 3 kW are required. Consequently, since the current flowing in output coil becomes large, leaking coil flux becomes large as well. As a result, parts used in the conveyance apparatus are heated by those leaking flux (induced heating) and power loss becomes large. Accordingly, when installing to forming apparatus, it is necessary to input more higher power.

When the winding number of the output coil is set four, power loss is drastically improved. When the same conductive cylinder member is heated, in order to raise temperature to 1000° C., 1.3 kW is required and to 1300° C., 2.2 kW is required. As a result, twenty five percent of input power can be reduced. Consequently, it is necessary to have 4 turns of output coil in order to realize a high efficiency heating with less input power.

Further, when the material of conductive cylinder member is structured by platinum with the same shape when structured by silicon carbide being a conductive ceramic described above, the same test was conducted. As a result of the test, at 1000° C. heating, 0.4 kW was required and 1300° C. heating, 0.7 kW was required. Based on this test, about one third input power was drastically saved. After 1300° C. heating was finished, silicon carbide-conductive cylinder member was observed. No change has been found with silicon carbide-conductive cylinder member. Even though, crystallization is seemed to progress in structure, there was not affection in the high frequency induction heating. Accordingly, by using precious metal such as platinum, less than 1 kW high frequency power source and four turn simple coil output circuit can easily raise temperature to 1300° C. with gas heating. Further, it is possible to realize clean gas heating having long life, high reliability without foreign matter or dirt comparing with a heater or other methods, by using precious metal, such as silicon carbide, etc When using conductive ceramic, such as silicon carbide, etc., as conductive material to be heated, through which gas passes, large input power is required, however it is possible to raise temperature up to 1500° C. When precious metal such as platinum, etc., is used, the temperature is limited to softened temperature (1200–1300° C.). However, since in this case, input power is low and heating can be efficiently performed, for example, it is useful to select the material of the conductive cylinder member so that when importance is placed on heating efficiency, precious metal is used; when importance is placed on thermostability, conductive ceramic is used.

While the preferred embodiments of the present invention have been described using specific terms, such description is for illustrative purposes only, and it is to be understood that changes and variations may be made without departing from the spirit or scope of the appended claims.

What is claimed is:

1. A conveyance apparatus comprising:

a transformer having a core, a primary coil connected to an alternate power source and a secondary coil connected to an output coil; and a holding section including a conductive member for heating fluid by high frequency induction heating based on magnetic field generated by the output coil, the holding section supplying fluid heated by the conductive member and holding an object heated by the heating fluid;

wherein, the secondary coil is capable of relatively moving to or relatively swinging on the core while the holding section moves.

2. The conveyance apparatus of claim 1, wherein the object is glass.

3. The conveyance apparatus of claim 1, wherein the conductive member is formed by conductive ceramic.

4. The conveyance apparatus of claim 3, wherein the conductive ceramic is silicon carbide.

5. The conveyance apparatus of claim 1, wherein the conductive member is formed by precious metal of any one of Pt, Au, Ir, Rh and Pd, or alloy including any one of Pt, Au, Ir, Rh and Pd.

6. The conveyance apparatus of claim 1, wherein the holding section has an arm capable of moving together with the secondary coil and the output coil, and the output coil is wound in a longitudinal direction of the arm.

7. The conveyance apparatus of claim 1, wherein the transformer includes only the secondary coil and the output coil as a secondary circuit.

8. The conveyance apparatus of claim 1, wherein the transformer includes a circuit having a condenser input type in a secondary circuit.

9. The conveyance apparatus of claim 1, wherein the secondary coil is coaxially wound around an axis of the primary coil.

10. The conveyance apparatus of claim 1, wherein the holding section floats the object by the fluid heated by the conductive member.

11. The conveyance apparatus of claim 10, wherein the holding section contains an internal surface forming a hole structured through the holding section in a gravity direction, and wherein the internal surface is formed into a tapered shape so that a diameter of the hole is extended toward an open edge of a top end portion of the hole, and the fluid heated by the conductive member is supplied through a bottom portion of the hole.

12. The conveyance apparatus of claim 11, wherein the conductive member is formed by precious metal of any one of Pt, Au, Ir, Rh and Pd, or alloy including any one of Pt, Au, Ir, Rh and Pd.

13. The conveyance apparatus of claim 11, further comprising:

a cooling apparatus for cooling the internal surface forming the hole by using coolant.

14. The conveyance apparatus of claim 13, wherein the coolant is liquid or air.

15. The conveyance apparatus of claim 11 further comprising:

a shutter capable of freely opening and closing the shutter being provided in a lower portion of the hole;

wherein the hole has a diameter through which the object can pass.

16. The conveyance apparatus of claim 1, wherein the holding section is arranged to be moved out from a position where the object is ejected from the holding section, within two seconds after ejecting the object.

17. The conveyance apparatus of claim 1, wherein the conveyance apparatus is applied to a forming apparatus having a forming die for forming an optical element.

18. The conveyance apparatus of claim 17, wherein the object is conveyed to the forming die while the object being held by the holding section is heated.

19. A forming apparatus for forming an optical element, the forming apparatus comprising:

the conveyance apparatus of claim 1, wherein the object is conveyed while heated by the conveyance apparatus.

20. A conveyance apparatus comprising:

a transformer having a core, a primary coil connected to an alternate power source and a secondary coil connected to an output coil; and a holding section including a conductive member for heating fluid by high frequency induction heating based on magnetic field generated by the output coil, the holding sectionsupplying fluid heated by the conductive member and holding an object heated by the heating fluid;

wherein, the secondary coil is capable of relatively moving to or relatively swinging on the core while the holding section moves, wherein the holding section floats the object by the fluid heated by the conductive member, wherein the holding section contains an internal surface forming a hole structured through the holding section in a gravity direction, wherein the internal surface is formed into a tapered shape so that a diameter of the hole is extended toward an open edge of a top end portion of the hole, and the fluid heated by the conductive member is supplied through a bottom portion of the hole, and wherein the conveyance apparatus further comprises a cooling apparatus for cooling the internal surface forming the hole by using coolant.

21. The conveyance apparatus of claim 20, wherein the coolant is liquid or air.

* * * * *